US006209630B1

(12) United States Patent
Yanai et al.

(10) Patent No.: US 6,209,630 B1
(45) Date of Patent: Apr. 3, 2001

(54) HEAT EXCHANGER

(75) Inventors: Hideyuki Yanai; Tadashi Tsunoda, both of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/269,832

(22) PCT Filed: Oct. 17, 1997

(86) PCT No.: PCT/JP97/03780

§ 371 Date: Apr. 2, 1999

§ 102(e) Date: Apr. 2, 1999

(87) PCT Pub. No.: WO98/16788

PCT Pub. Date: Apr. 23, 1998

(30) Foreign Application Priority Data

Oct. 17, 1996 (JP) ..... 8-275051
Oct. 17, 1996 (JP) ..... 8-275052
Oct. 17, 1996 (JP) ..... 8-275054

(51) Int. Cl.[7] ..... F28D 9/00
(52) U.S. Cl. ..... 165/165; 165/146; 165/DIG. 399
(58) Field of Search ..... 165/146, 165, 165/166, 154

(56) References Cited

U.S. PATENT DOCUMENTS 4,527,622 7/1985 Weber .

FOREIGN PATENT DOCUMENTS

444542 * 2/1942 (BE) .
444 542 3/1942 (BE) .
2408462 * 8/1975 (DE) .
1208367 * 2/1960 (FR) .
56-500424 4/1981 (JP) .
57-2983 1/1982 (JP) .
57-500945 5/1982 (JP) .
58-40116 3/1983 (JP) .
59-63491 4/1984 (JP) .
59-183296 10/1984 (JP) .
62-233691 10/1987 (JP) .
WO97/06395 2/1997 (WO) .
WO98/33030 7/1998 (WO) .

* cited by examiner

*Primary Examiner*—Allen Flanigan
(74) *Attorney, Agent, or Firm*—Arent Fox Kintner Plotkin & Kahn, PLLC

(57) ABSTRACT

A heat exchanger which is constructed such that combustion gas passages 4 for passage of combustion gas and air passages 5 for passages of air are arranged alternately, and the heat exchanger is cut at one end side thereof in an unequal angle configuration to form combustion gas passage inlets 11 and air passage outlets 16, and cut at the other end side thereof in an unequal angle configuration to form combustion gas passage outlets 12 and air passage inlets 15. the combustion gas passage inlets 11 and combustion gas passage outlets 12, through which a combustion gas having a larger volume flow rate passes, are formed on a long side of an angle, and the air passage inlets 15 and air passage outlets 16, through which an air having a smaller volume flow rate passes, are formed on a short side of an angle. Accordingly, it is possible to avoid an increase in pressure loss caused by a volume flow rate difference between a high temperature fluid and a low temperature fluid to reduce pressure loss in the entire heat exchanger.

1 Claim, 15 Drawing Sheets

HEAT EXCHANGER

FIELD OF THE INVENTION

The present invention relates to a heat exchanger including high-temperature fluid passages and low-temperature fluid passages defined alternately by folding a plurality of first heat-transfer plates and a plurality of second heat-transfer plates in a zigzag fashion.

BACKGROUND ART

A heat exchanger is already known from Japanese Patent Application Laid-open Nos. 59-183296 and 59-63491, which is formed by cutting, into an angle shape having two end edges, opposite ends in a flowing direction of each of first and second heat-transfer plates disposed adjacently and alternately with each other to define high-temperature fluid passages and low-temperature fluid passages. A heat exchanger is also already known from Japanese Patent Application Laid-open No. 58-40116, which includes high-temperature fluid passages and low-temperature fluid passages alternately defined by folding a band-shaped heat-transfer plate in a zigzag fashion.

The volume flow rate of a high-temperature fluid flowing through high-temperature fluid passages in a heat exchanger is not necessarily equal to the volume flow rate of a low-temperature fluid flowing through low-temperature fluid passages in the heat exchanger. For example, in the case of a heat exchanger used in a gas turbine engine, the volume flow rate of a high-temperature fluid comprising a combustion gas is larger than the volume flow rate of a low-temperature fluid comprising air. However, the above known heat exchanger suffers from a problem that the pressure loss of the fluid having the larger volume flow rate is increased and the pressure loss in the entire heat exchanger is also increased, because the lengths of the two end edges of the angle shape are set equal to each other.

When the heat-transfer plates formed in the zigzag folded fashion are disposed radiately to define high-temperature fluid passages and low-temperature fluid passages alternately with each other in a circumferential direction, if an attempt is made to form a heat exchanger having a center angle of 360° from a single folding plate blank, the folding plate blank is required to have a large length, thereby making it difficult to produce the heat exchanger. Moreover, there is a problem that the yield of the blank is degraded. Therefore, it is conceived that a module having a predetermined center angle is formed from a folding plate blank having a suitable length and a plurality of the modules are connected together in the circumferential direction to form a heat exchanger having a center angle of 360°. If the structure of bond zones between adjacent modules are not taken into consideration sufficiently, the following problem is encountered: the heat-transfer plates may be fallen down in the circumferential direction in the vicinity of the bond zones, whereby they may not be arranged correctly in a radial direction, moreover, the heat mass in the bond zones may be increased. Another problem is that if the accuracy of the end edges of the folding plate blank is not controlled precisely, a misalignment is liable to occur between the end edges of the folding plate blank in the bond zones.

DISCLOSURE OF THE INVENTION

Accordingly, it is a first object of the present invention to ensure that an increase in pressure loss based on a difference between the volume flow rates of the high-temperature and low-temperature fluids is avoided, thereby decreasing the pressure loss in the entire heat exchanger. It is a second object of the present invention to ensure that when an annular-shaped heat exchanger is formed by bonding a plurality of modules together, the generation of an increase in heat mass and an increase in flow path resistance to the fluid in the bond zones is avoided. Further, it is a third object of the present invention to ensure that when an annular-shaped heat exchanger is formed by bonding a plurality of modules together, the misalignment of the bond zones and the increase in heat mass are suppressed to the minimum, while preventing the falling of the heat-transfer plate in the circumferential direction.

To achieve the above object, according to a first aspect and feature of the present invention, there is provided a heat exchanger, which is formed from a folding plate blank comprising a plurality of first heat-transfer plates and a plurality of second heat-transfer plates which are alternately connected together through folding lines, and in which high-temperature fluid passages and low-temperature fluid passages are alternately defined between adjacent ones of the first and second heat-transfer plates by folding the folding plate blank in a zigzag fashion along the folding lines, and opposite ends of each of the first and second heat-transfer plates in a flowing direction are cut into angle shapes each having two end edges; whereby a high-temperature fluid passage inlet is defined by closing one of the two end edges and opening the other end edge of one of the angle shapes at one end of the high-temperature fluid passage in the flowing direction, and a high-temperature fluid passage outlet is defined by closing one of the two end edges and opening the other end edge of the other angle shape at the other end of the high-temperature fluid passage in the flowing direction; and a low-temperature fluid passage inlet is defined by opening one of the two end edges and closing the other of the two end edges of the other angle shape at one end of the low-temperature fluid passage in the flowing direction, and a low-temperature fluid passage outlet is defined by opening one of the two end edges and closing the other of the two end edges of the one of the angle shapes at the other end of the low-temperature fluid passage in the flowing direction, characterized in that the lengths of the two end edges of each of the angle shapes are unequal to each other, and a flow rate of a fluid in the high-temperature fluid passage inlet and outlet is reduced, in order to suppress to the minimum a sum of pressure losses produced in the high-temperature fluid passage inlet and outlet and the low-temperature fluid passage inlet and outlet.

With the above arrangement, when the one ends of the first and second heat-transfer plates in the flowing direction are cut into the angle shape to define the high-temperature fluid passage inlet and the low-temperature fluid passage outlet, and the other ends of the first and second heat-transfer plates in the flowing direction are cut into the angle shape to define the high-temperature fluid passage outlet and the low-temperature fluid passage inlet, the lengths of the two end edges of each of the angle shapes are unequal to each other. Thus, the flow rate of the high-temperature fluid flowing in the high-temperature fluid passages can be relatively reduced, thereby suppressing the generation of a pressure loss in the entire heat exchanger to the minimum.

To achieve the second object, according to a second aspect and feature of the present invention, there is provided a heat exchanger, having axially extending high-temperature fluid passages and low-temperature fluid passages defined alternately in a circumferential direction in an annular space that is defined between a radially outer peripheral wall and a radially inner peripheral wall, the heat exchanger comprising a plurality of modules formed by folding a plurality of folding plate blanks each comprised of a plurality of first heat-transfer plates and a plurality of second heat-transfer plates which are alternately connected together through folding lines, in a zigzag fashion along the folding lines, the high-temperature fluid passages and the low-temperature fluid passages being defined alternately in the circumferential direction by the first and second heat-transfer plates disposed radiately between the radially outer peripheral wall and the radially inner peripheral wall, by connecting the plurality of modules together in the circumferential direction; and a high-temperature fluid passage inlet and a low-temperature fluid passage outlet which are defined so as to open at axially opposite ends of the high-temperature fluid passages, and a low-temperature fluid passage inlet and a low-temperature fluid passage outlet which are defined so as to open at axially opposite ends of the low-temperature fluid passages, characterized in that end edges of said folding plate blanks forming the circumferentially adjacent modules are brought into direct contact with each other and bonded to each other.

With the above arrangement, since the end edges of the folding plate blanks forming the circumferentially adjacent modules are brought into direct contact with each other and bonded to each other, it is unnecessary to use a special bonding member and to increase the wall thickness of the folding plate blank. Thus, the number of parts and the processing cost are reduced, and moreover, an increase in heat mass in the bond zone and an increase in flow path resistance to the fluid can be avoided.

To achieve the third object, according to a third aspect and feature of the present invention, there is provided a heat exchanger, having axially extending high-temperature fluid passages and low-temperature fluid passages defined alternately in a circumferential direction in an annular space that is defined between a radially outer peripheral wall and a radially inner peripheral wall, the heat exchanger comprising a plurality of modules formed by folding a plurality of folding plate blanks each comprised of a plurality of first heat-transfer plates and a plurality of second heat-transfer plates which are alternately connected together through folding lines, in a zigzag fashion along the folding lines, the high-temperature fluid passages and the low-temperature fluid passages being defined alternately in the circumferential direction by the first and second heat-transfer plates disposed radiately between the radially outer peripheral wall and the radially inner peripheral wall, by connecting the plurality of modules together in the circumferential direction; and a high-temperature fluid passage inlet and a low-temperature fluid passage outlet which are defined so as to open at axially opposite ends of the high-temperature fluid passages,,and a low-temperature fluid passage inlet and a low-temperature fluid passage outlet which are defined so as to open at axially opposite ends of the low-temperature fluid passages, characterized in that a partition plate is radially disposed between the radially outer peripheral wall and the radially inner peripheral wall, and end edges of the folding plate blanks forming the modules are bonded to opposite sides of the partition plate.

With the above arrangement, since the partition plate is radially disposed between the radially outer peripheral wall and the radially inner peripheral wall, and the end edges of the folding plate blanks forming the modules are bonded to opposite sides of the partition plate, the first and second heat-transfer plates of the modules can be arranged exactly radiately with the partition plate used as guide. Moreover, the partition plate made of a plate blank is only added and hence, the increase in heat mass in the bond zone is suppressed to the minimum. Further, the end edges of the folding plate blanks are not in direct contact with each other and hence, any dimensional error in the end edge of the folding plate blank can be absorbed. Additionally, a dead space which is neither a combustion gas passage nor an air passage is not created and hence, there is not a possibility that the heat exchange efficiency may be reduced.

BRIEF DESCRIPTION OF THE DRAWINGS

FIGS. 1 to 11 shown a first embodiment of the present invention, wherein FIG. 1 is a side view of an entire gas turbine engine;

FIG. 2 is a sectional view taken along a line 2—2 in FIG. 1;

FIG. 3 is an enlarged sectional view taken along a line 3—3 in FIG. 2 (a sectional view of combustion gas passages);

FIG. 4 is an enlarged sectional view taken along a line 4—4 in FIG. 2 (a sectional view of air passages);

FIG. 5 is an enlarged sectional view taken along a line 5—5 in FIG. 3;

FIG. 6 is an enlarged sectional view taken along a line 6—6 in FIG. 3;

FIG. 7 is a developed view of a folding plate blank;

FIG. 8 is a perspective view of an essential portion of a heat exchanger;

FIG. 9 is a pattern view showing flows of a combustion gas and air;

BEST MODE FOR CARRYING OUT THE INVENTION

A first embodiment of the present invention will now be described with reference to FIGS. 1 to 11.

Figure 1:
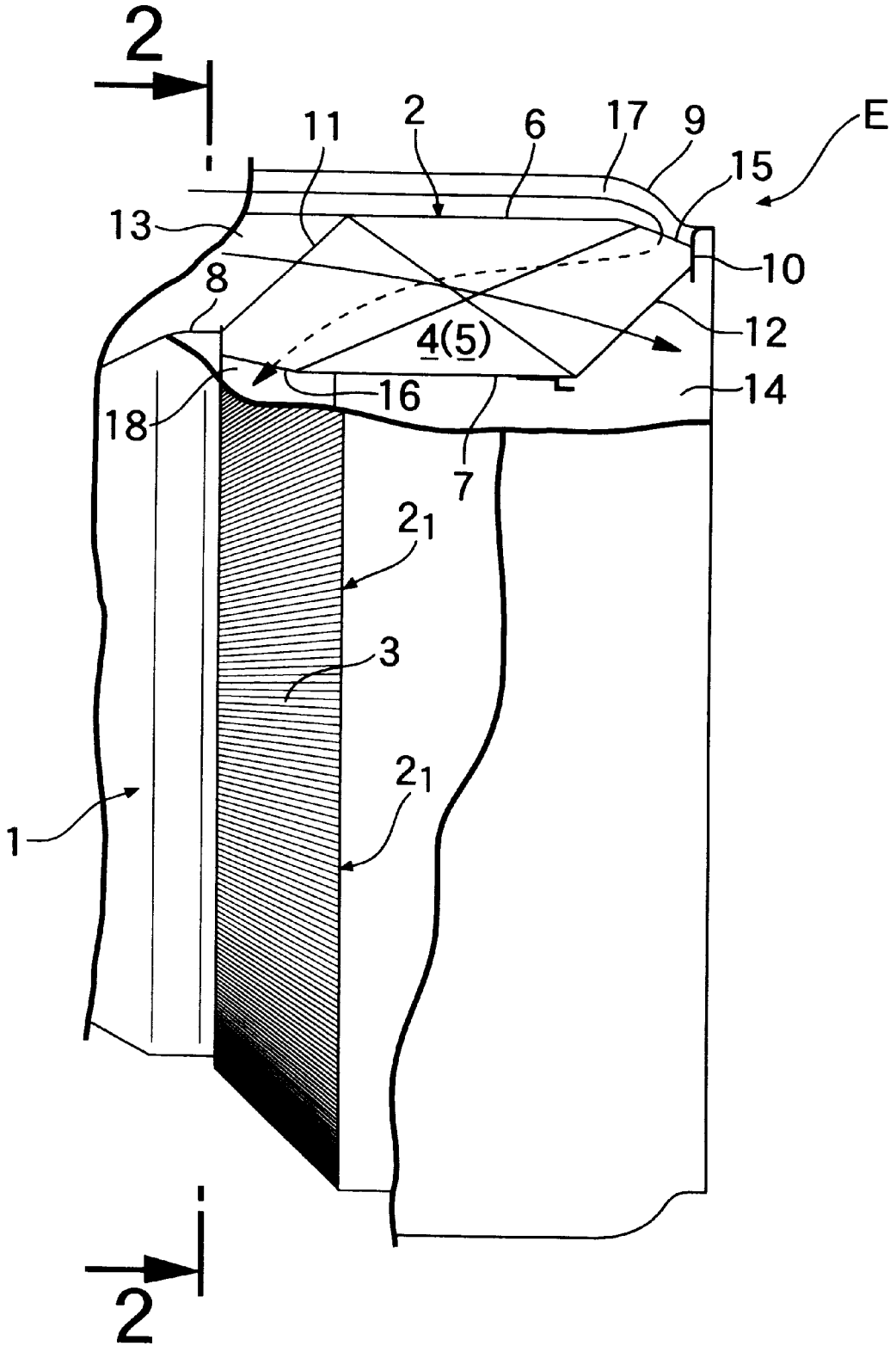
Figure 2:
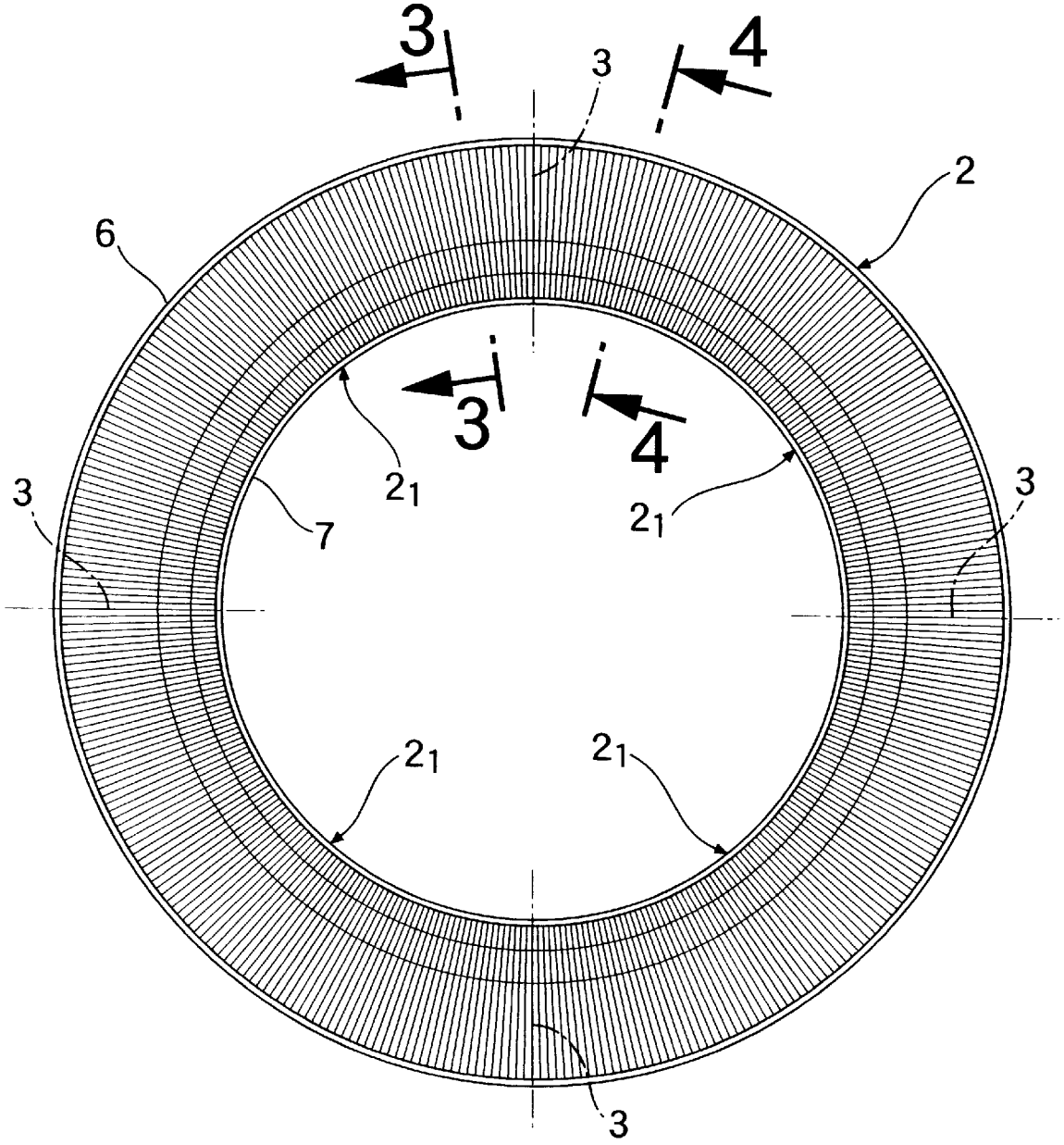

As shown in FIGS. 1 and 2, a gas turbine engine E includes an engine body 1 in which a combustor, a compressor, a turbine and the like (which are not shown) are accommodated. An annular-shaped heat exchanger 2 is disposed to surround an outer periphery of the engine body 1. The heat exchanger 2 comprises four modules $\mathbf{2}_1$ having a center angle of 90° and arranged in a circumferential direction with bond surfaces 3 interposed therebetween. Combustion gas passages 4 and air passages 5 are circumferentially alternately provided in the heat exchanger 2 (see FIGS. 5 and 6), so that a combustion gas of a relative high temperature passed through turbine is passed through the combustion gas passages 4, and air of a relative low temperature compressed in the compressor is passed through the air passages 5. A section in FIG. 1 corresponds to the combustion gas passages 4, and the air passages 5 are defined adjacent this side and the other side of the combustion gas passages 4.

The sectional shape of the heat exchanger 2 taken along an axis is an axially longer and radially shorter flat hexagonal shape. A radially outer peripheral surface of the heat exchanger 2 is closed by a larger-diameter cylindrical outer casing 6, and a radially inner peripheral surface of the heat exchanger 2 is closed by a smaller-diameter cylinder inner casing 7. A front end side (a left side in FIG. 1) in the section of the heat exchanger 2 is cut into an unequal-length angle shape, and an end plate 8 connected to an outer periphery of the engine body 1 is brazed to an end surface corresponding to an apex of the angle shape. A rear end side (a right side in FIG. 1) in the section of the heat exchanger 2 is cut into an unequal-length angle shape, and an end plate 10 connected to a rear outer housing 9 is brazed to an end surface corresponding to an apex of the angle shape.

Each of the combustion gas passages 4 in the heat exchanger 2 includes a combustion gas passage inlet 11 and a combustion gas passage outlet 12 at the left and upper portion and the right and lower portion of FIG. 1, respectively. A combustion gas introducing space (referred to as a combustion gas introducing duct) 13 defined along the outer periphery of the engine body 1 is connected at its downstream end to the combustion gas passage inlet 11. A combustion gas discharging space (referred to as a combustion gas discharging duct) 14 extending within the engine body 1 is connected at its upstream end to the combustion gas passage outlet 12.

Each of the air passages 5 in the heat exchanger 2 includes an air passage inlet 15 and an air passage outlet 16 at the right and upper portion and the left and lower portion of FIG. 1, respectively. An air introducing space (referred to as an air introducing duct) 17 defined along an inner periphery of the rear outer housing 9 is connected at its downstream end to the air passage inlet 15. An air discharging space (referred to as an air discharging duct) 18 extending within the engine body 1 is connected at its upstream end to the air passage outlet 16.

Figure 3:
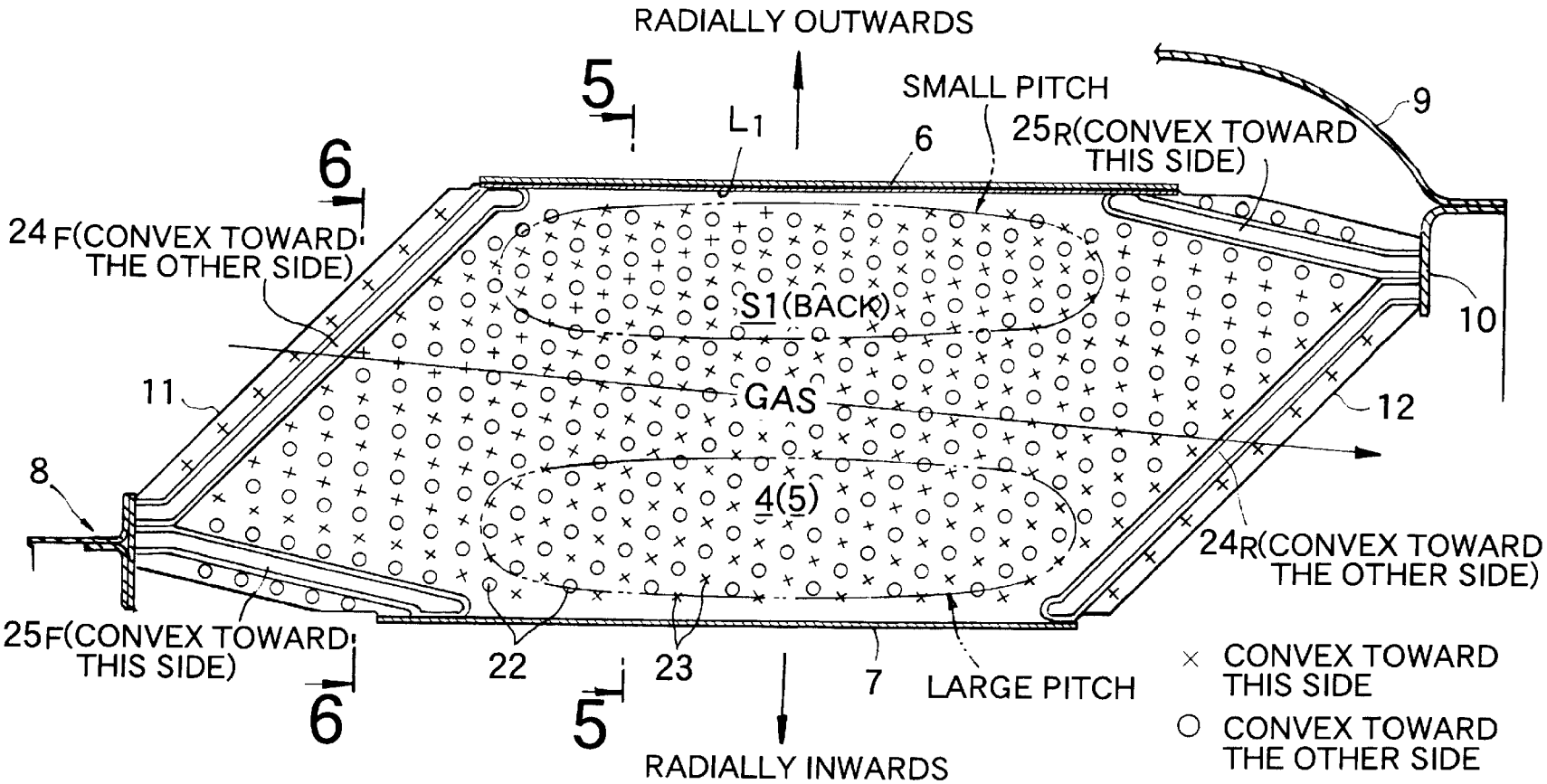
Figure 4:
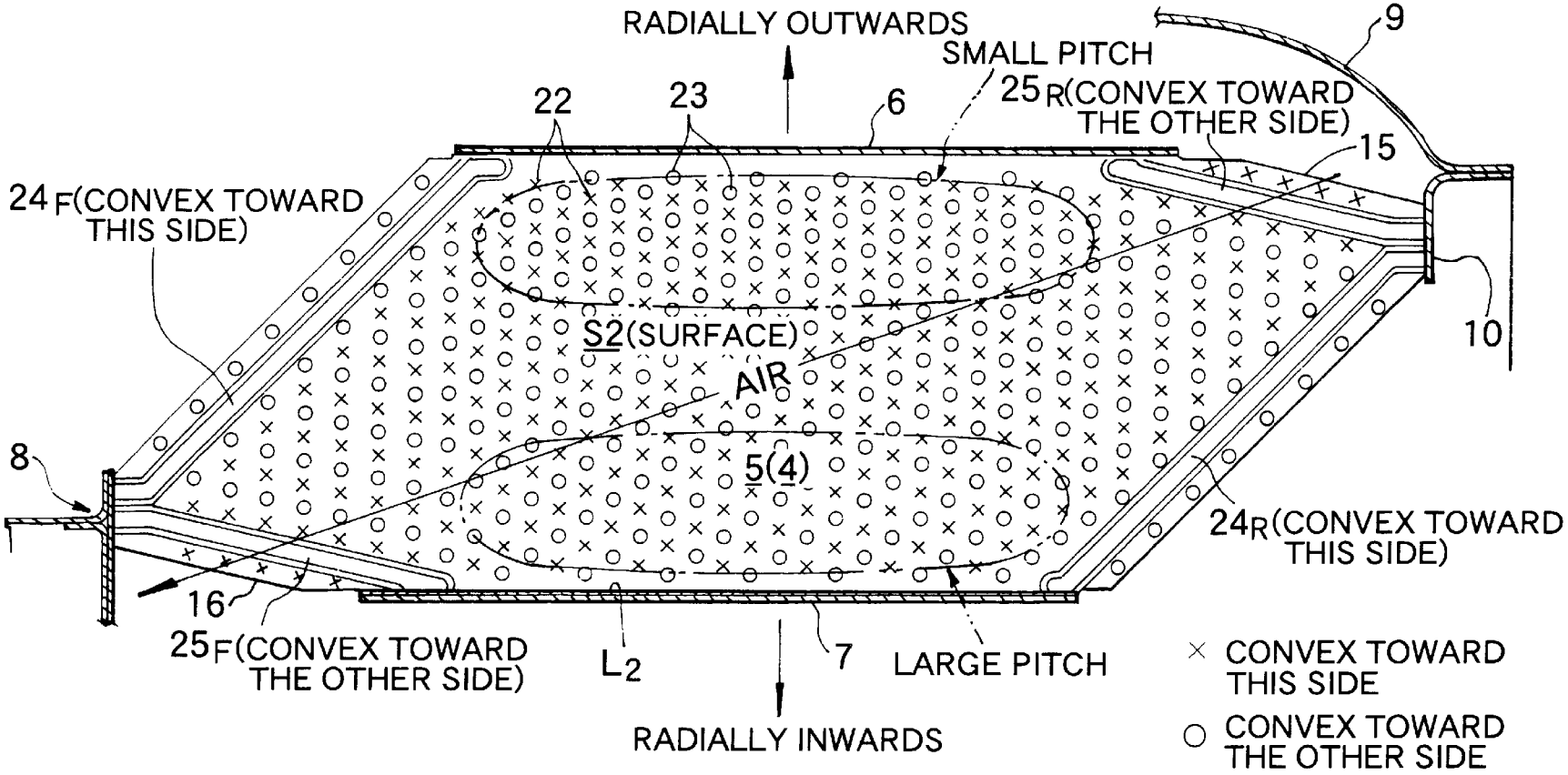
Figure 9:
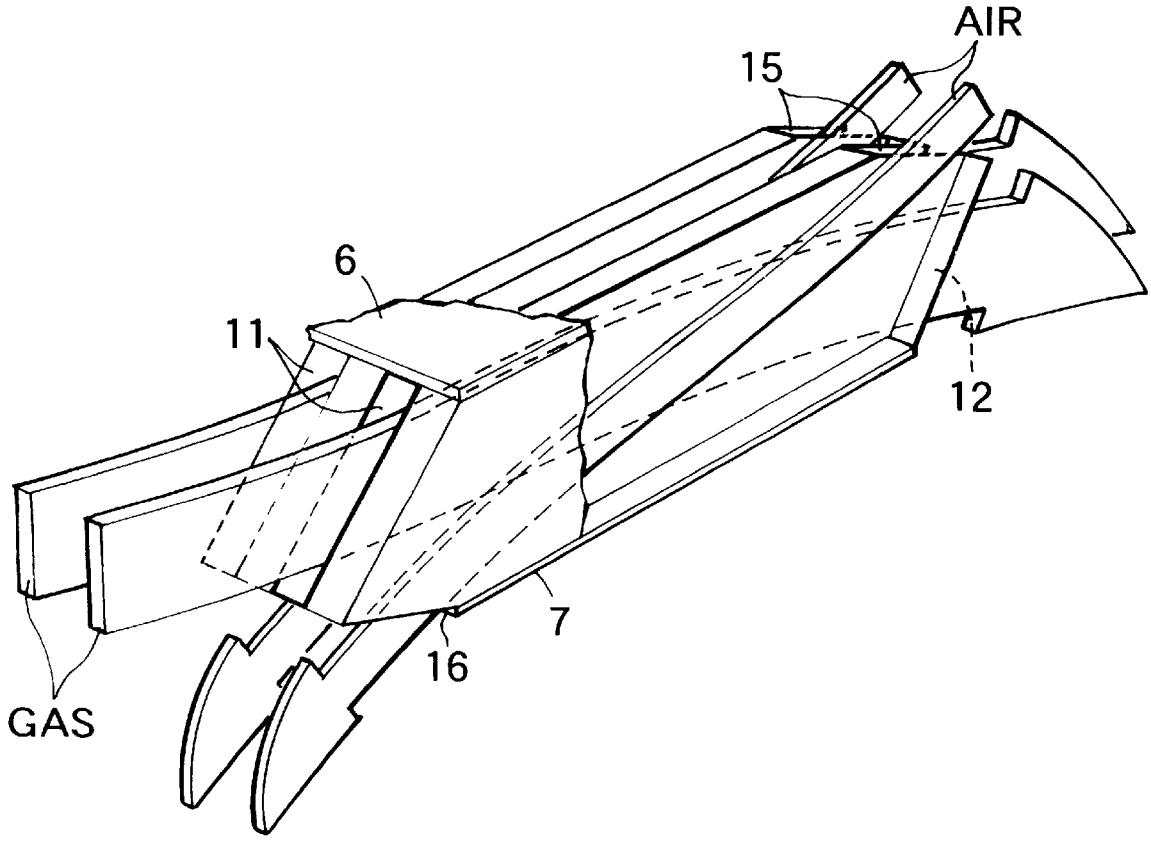

In this manner, the combustion gas and the air flow in opposite directions from each other and cross each other as shown in FIGS. 3, 4 and 9, whereby a counter flow and a so-called cross-flow are realized with a high heat-exchange efficiency. Thus, by allowing a high-temperature fluid and a low-temperature fluid to flow in opposite directions from each other, a large difference in temperature between the high-temperature fluid and the low-temperature fluid can be maintained over the entire length of the flow paths, thereby enhancing the heat-exchange efficiency.

The temperature of the combustion gas which has driven the turbine is about 600 to 700° C. in the combustion gas passage inlets 11. The combustion gas is cooled down to about 300 to 400° C. in the combustion gas passage outlets 12 by conducting a heat-exchange between the combustion gas and the air when the combustion gas passes through the combustion gas passages 4. On the other hand, the temperature of the air compressed by the compressor is about 200 to 300° C. in the air passage inlets 15. The air is heated up to about 500 to 600° C. in the air passage outlets 16 by conducting a heat-exchange between the air and the combustion gas, which occurs when the air passes through the air passages 5.

The structure of the heat exchanger 2 will be described below with reference to FIGS. 3 to 8.

Figure 7:
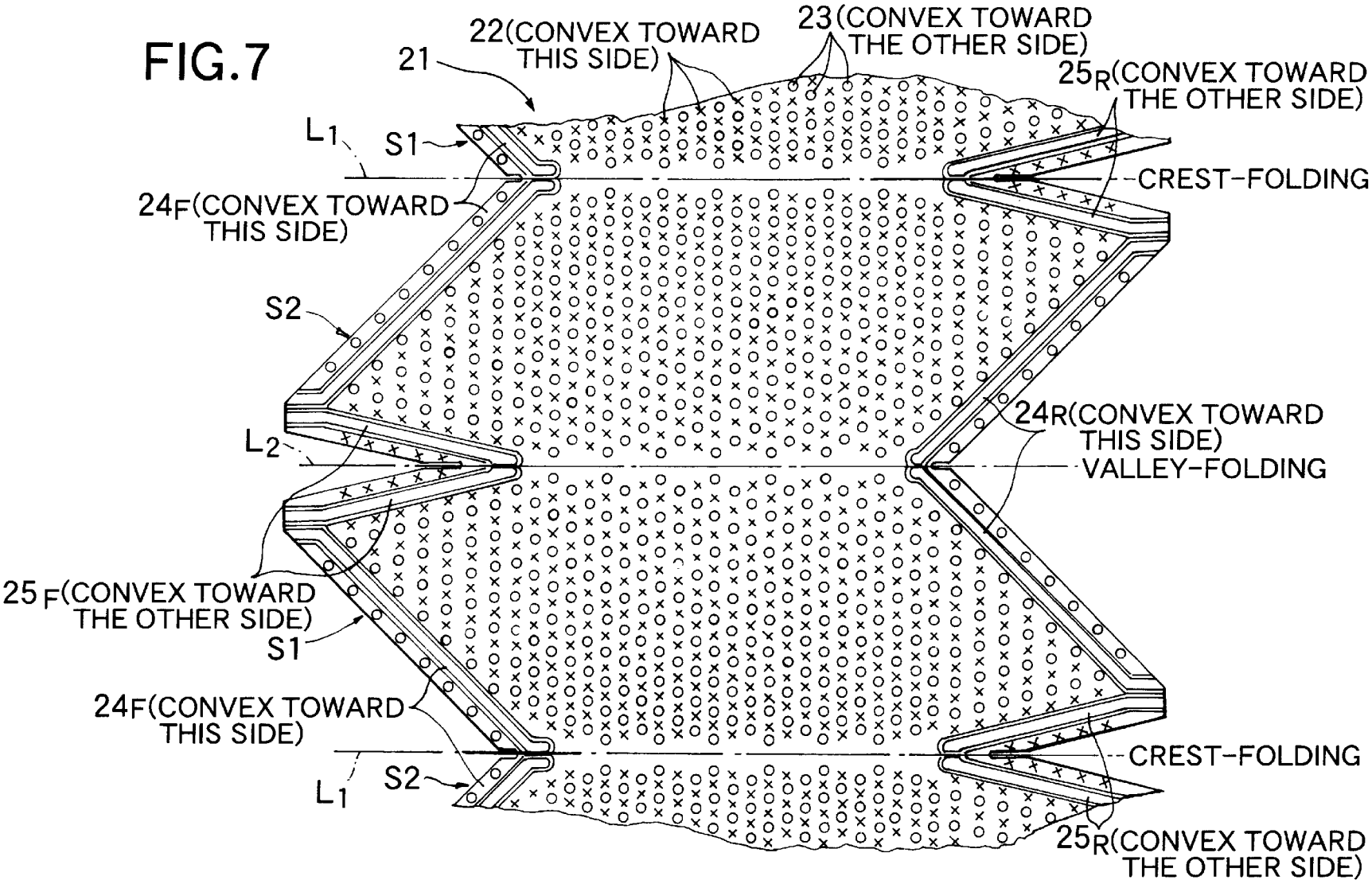
Figure 8:
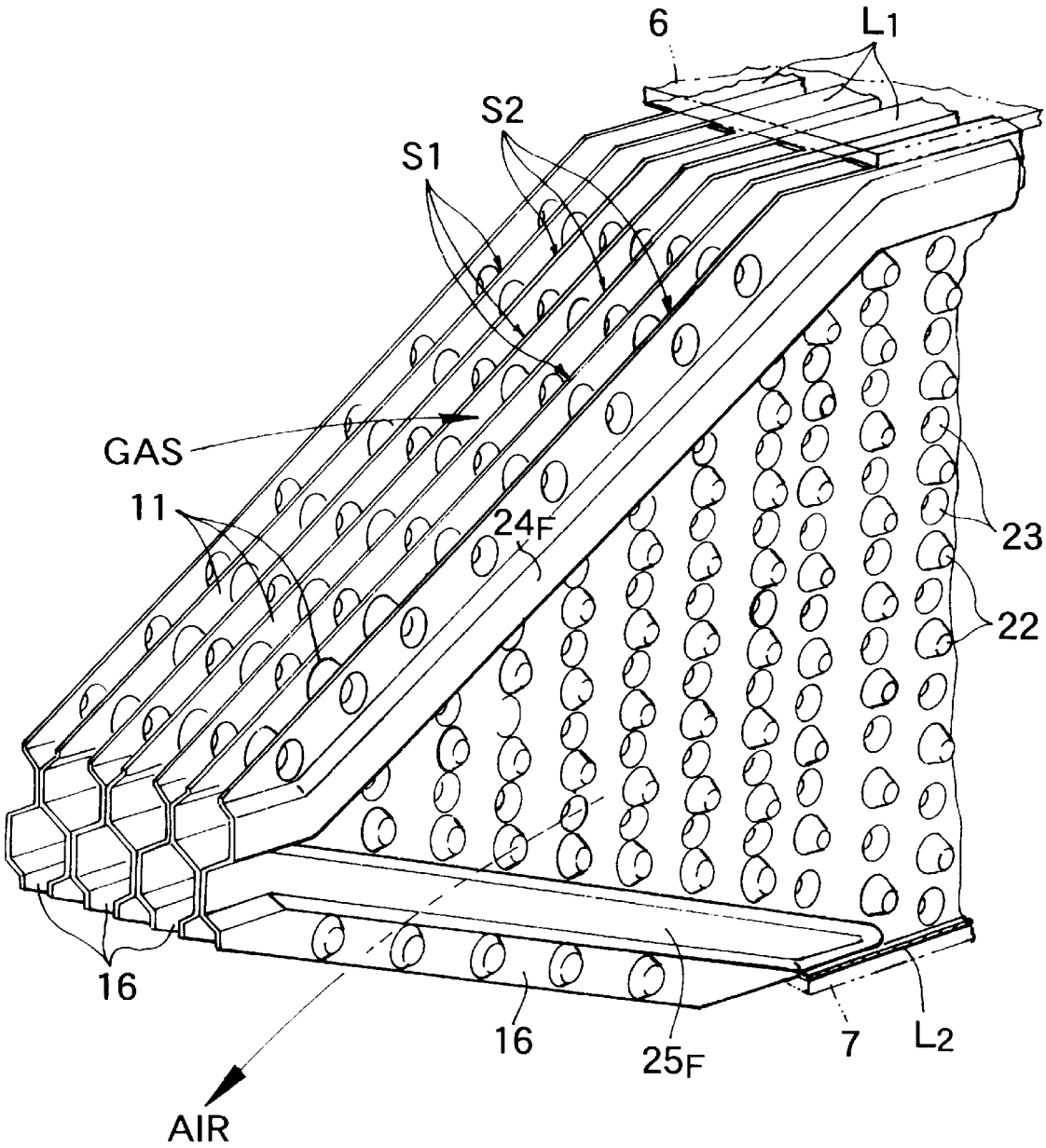

As shown in FIGS. 3, 4 and 7, each of the modules $\mathbf{2}_1$ of the heat exchanger 2 is made from a folding plate blank 21 produced by previously cutting a thin metal plate such as a stainless steel into a predetermined shape and then forming an irregularity on a surface of the cut plate by pressing. The folding plate blank 21 is comprised of first heat-transfer plates S1 and second heat-transfer plates S2 disposed alternately, and is folded into a zigzag fashion along crest-folding lines $L_1$ and valley-folding lines $L_2$. The term "crest-folding" means folding into a convex toward this side or a closer side from the drawing sheet surface, and the term "valley-folding" means folding into a convex toward the other side or a far side from the drawing sheet surface. Each of the crest-folding lines $L_1$ and the valley-folding lines $L_2$ is not a simple straight line, but actually comprises an arcuate folding line or two parallel and adjacent folding lines for the purpose of forming a predetermined space between each of the first heat-transfer plates S1 and each of the second heat-transfer plates S2.

A large number of first projections 22 and a large number of second projections 23, which are disposed at unequal distances, are formed on each of the first and second heat-transfer plates S1 and S2 by pressing. The first projections 22 indicated by a mark X in FIG. 7 protrude toward this side on the drawing sheet surface of FIG. 7, and the second projections 23 indicated by a mark 0 in FIG. 7 protrude toward the other side on the drawing sheet surface of FIG. 7. The first and second projections 22 and 23 are arranged alternately (i.e., so that the first projections 22 are not continuous to one another and the second projections 23 are not continuous to one another).

First projection stripes $\mathbf{24}_F$ and second projection stripes $\mathbf{25}_F$ are formed by pressing at those front and rear ends of the first and second heat-transfer plates S1 and S2 which are cut into the angle shape. The first projection stripes $\mathbf{24}_F$ protrude toward this side on the drawing sheet surface of FIG. 7, and the second projection stripes $\mathbf{25}_F$ protrude toward the other side on the drawing sheet surface of FIG. 7. In any of the first and second heat-transfer plates S1 and S2, a pair of the front and rear first projection stripes $\mathbf{24}_F$, $\mathbf{24}_R$ are disposed at diagonal positions, and a pair of the front and rear second projection stripes $\mathbf{25}_F$, $\mathbf{25}_R$ are disposed at other diagonal positions.

The first projections 22, the second projections 23, the first projection stripes $\mathbf{24}_F$, $\mathbf{24}_R$ and the second projection stripes $\mathbf{25}_F$, $\mathbf{25}_R$ of the first heat-transfer plate S1 shown in FIG. 3 are in an opposite recess-projection relationship with respect to that in the first heat-transfer plate S1 shown in FIG. 7. This is because FIG. 3 shows a state in which the first heat-transfer plate S1 is viewed from the back side.

Figures 5, 5A:
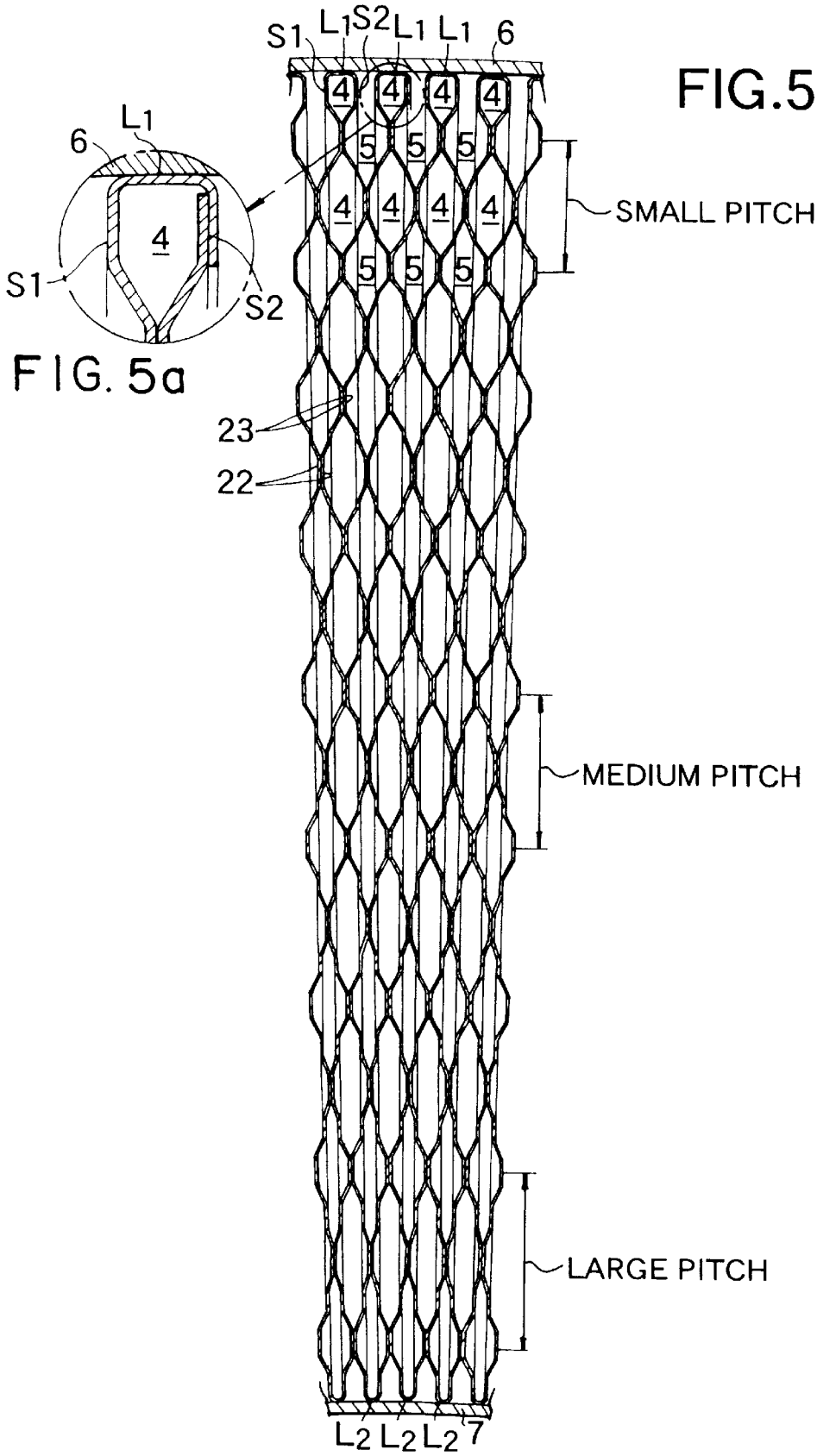
Figure 6:
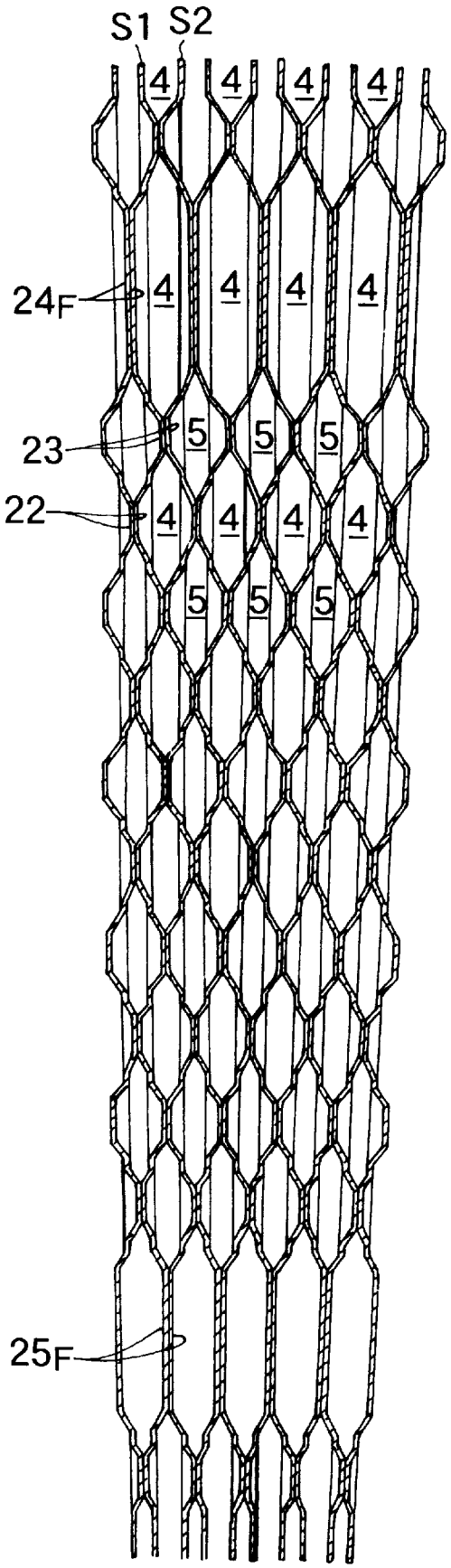

As can be seen from FIGS. 5 to 7, when the first and second heat-transfer plates S1 and S2 of the folding plate blank 21 are folded along the crest-folding lines $L_1$ to form the combustion gas passages 4 between both the heat-transfer plates S1 and S2, tip ends of the second projections 23 of the first heat-transfer plate S1 and tip ends of the second projections 23 of the second heat-transfer plate S2 are brought into abutment against each other and brazed to each other. In addition, the second projection stripes $\mathbf{25}_F$, $\mathbf{25}_R$ of the first heat-transfer plate S1 and the second projection stripes $\mathbf{25}_F$, $\mathbf{25}_R$ of the second heat-transfer plate S2 are brought into abutment against each other and brazed to each other. Thus, a left lower portion and a right upper portion of the combustion gas passage 4 shown in FIG. 3 are closed, and each of the first projection stripes $\mathbf{24}_F$, $\mathbf{24}_R$ of the first heat-transfer plate S1 and each of the first projection stripes $\mathbf{24}_F$, $\mathbf{24}_R$ of the second heat-transfer plate S2 are opposed to each other with a gap left therebetween. Further, the combustion gas passage inlet 11 and the combustion gas passage outlet 12 are defined in a left, upper portion and a right, lower portion of the combustion gas passage 4 shown in FIG. 3, respectively.

When the first heat-transfer plates S1 and the second heat-transfer plates S2 of the folding plate blank 21 are folded along the valley-folding line $L_2$ to form the air passages 5 between both the heat-transfer plates S1 and S2, the tip ends of the first projections 22 of the first heat-transfer plate S1 and the tip ends of the first projections 22 of the second heat-transfer plate S2 are brought into abutment against each other and brazed to each other. In addition, the first projection stripes $\mathbf{24}_F$, $\mathbf{24}_R$ of the first heat-transfer plate S1 and the first projection stripes $\mathbf{24}_F$, $\mathbf{24}_R$ of the second heat-transfer plate S2 are brought into abutment against each other and brazed to each other. Thus, a left upper portion and a right lower portion of the air passage 5 shown in FIG. 4 are closed, and each of the second projection stripes $\mathbf{25}_F$, $\mathbf{25}_R$ of the first heat-transfer plate S1 and each of the second projection stripes $\mathbf{25}_F$, $\mathbf{25}_R$ of the second heat-transfer plate S2 are opposed to each other with a gap left therebetween. Further, the air passage inlet 15 and the air passage outlet 16 are defined at a right upper portion and a left lower portion of the air passage 5 shown in FIG. 4, respectively.

A state in which the air passages 5 have been closed by the first projection stripes $\mathbf{24}_F$ is shown in an upper portion (a radially outer portion) of FIG. 6, a state in which the combustion gas passages 4 have been closed by the second projection stripes $\mathbf{25}_F$ is shown in a lower portion (a radially outer portion) of FIG. 6.

Each of the first and second projections 22 and 23 has a substantially truncated conical shape, and the tip ends of the first and second projections 22 and 23 are in surface contact with each other to enhance the brazing strength. Each of the first and second projection stripes $\mathbf{24}_F$, $\mathbf{24}_R$ and $\mathbf{25}_F$, $\mathbf{25}_R$ has also a substantially trapezoidal section, and the tip ends of the first and second projection stripes $\mathbf{24}_F$, $\mathbf{24}_R$ and $\mathbf{25}_F$, $\mathbf{25}_R$ are also in surface contact with each other to enhance the brazing strength.

As can be seen from FIG. 5, radially inner peripheral portions of the air passages 5 are automatically closed, because they correspond to the folded portion (the valley-folding line $L_2$) of the folding plate blank 21, but radially outer peripheral portions of the air passages 5 are opened, and such opening portions are closed by brazing to the outer casing 6. On the other hand, radially outer peripheral portions of the combustion gas passages 4 are automatically closed, because they correspond to the folded portion (the crest-folding line $L_1$) of the folding plate blank 21, but radially inner peripheral portions of the combustion gas passages 4 are opened, and such opening portions are closed by brazing to the inner casing 7.

When the folding plate blank 21 is folded in the zigzag fashion, the adjacent crest-folding lines $L_1$ cannot be brought into direct contact with each other, but the distance between the crest-folding lines $L_1$ is maintained constant by the contact of the first projections 22 to each other. In addition, the adjacent valley-folding lines $L_2$ cannot be brought into direct contact with each other, but the distance between the valley-folding lines $L_2$ is maintained constant by the contact of the second projections 23 to each other.

When the folding plate blank 21 is folded in the zigzag fashion to produce the modules $\mathbf{2}_1$ of the heat exchanger 2, the first and second heat-transfer plates S1 and S2 are disposed radiately from the center of the heat exchanger 2. Therefore, the distance between the adjacent first and second heat-transfer plates S1 and S2 assumes the maximum in the radially outer peripheral portion which is in contact with the outer casing 6, and the minimum in the radially inner peripheral portion which is in contact with the inner casing 7. For this reason, the heights of the first projections 22, the second projections 23, the first projection stripes $\mathbf{24}_F$, $\mathbf{24}_R$ and the second projection stripes $\mathbf{25}_F$, $\mathbf{25}_R$ are gradually increased outwards from the radially inner side, whereby the first and second heat-transfer plates S1 and S2 can be disposed exactly radiately (see FIGS. 5 and 6).

By employing the above-described structure of the radiately folded plates, the outer casing 6 and the inner casing 7 can be positioned concentrically, and the axial symmetry of the heat exchanger 2 can be maintained accurately.

By forming the heat exchanger 2 by a combination of the four modules $\mathbf{2}_1$ having the same structure, the manufacture of the heat exchanger can be facilitated, and the structure of the heat exchanger can be simplified. In addition, by folding the folding plate blank 21 radiately and in the zigzag fashion to continuously form the first and second heat-transfer plates S1 and S2, the number of parts and the number of brazing points can remarkably be decreased, and moreover, the dimensional accuracy of a completed article can be enhanced, as compared with a case where a large number of first heat-transfer plates S1 independent from one another and a large number of second heat-transfer plates S2 independent from one another are brazed alternately.

As can be seen from FIG. 5, when the modules $\mathbf{2}_1$ of the heat exchanger 2 are bonded to one another at the bond surfaces 3 (see FIG. 2), end edges of the first heat-transfer plates S1 folded into a J-shape beyond the crest-folding line $L_1$ and end edges of the second heat-transfer plates S2 cut rectilinearly at a location short of the crest-folding line $L_1$ are superposed on each other and brazed to each other. By employing the above-described structure, a special bonding member for bonding the adjacent modules $\mathbf{2}_1$ to each other is not required, and a special processing for changing the thickness of the folding plate blank 21 is not required. Therefore, the number of parts and the processing cost are reduced, and further an increase in heat mass in the bonded zone is avoided. Moreover, a dead space which is neither the combustion gas passages 4 nor the air passages 5 is not created and hence, the increase in flow path resistance is suppressed to the minimum, and there is not a possibility that the heat exchange efficiency may be reduced.

During operation of the gas turbine engine E, the pressure in the combustion gas passages 4 is relatively low, and the pressure in the air passages 5 is relatively high. For this reason, a flexural load is applied to the first and second heat-transfer plates S1 and S2 due to a difference between the pressures, but a sufficient rigidity capable of withstanding such load can be obtained by virtue of the first and second projections 22 and 23 which have been brought into abutment against each other and brazed with each other.

In addition, the surface areas of the first and second heat-transfer plates S1 and S2 (i.e., the surface areas of the combustion gas passages 4 and the air passages 5) are increased by virtue of the first and second projections 22 and 23. Moreover, the flows of the combustion gas and the air are agitated and hence, the heat exchange efficiency can be enhanced.

The unit amount $N_{tu}$ of heat transfer representing the amount of heat transferred between the combustion gas passages 4 and the air passages 5 is given by the following equation (1):

$$N_{tu}=(K\times A)/[C\times(dm/dt)] \quad (1)$$

In the above equation (1), K is an overall heat transfer coefficient of the first and second heat-transfer plates S1 and S2; A is an area (a heat-transfer area) of the first and second heat-transfer plates S1 and S2; C is a specific heat of a fluid; and dm/dt is a mass flow rate of the fluid flowing in the heat transfer area. Each of the heat transfer area A and the specific heat C is a constant, but each of the overall heat transfer coefficient K and the mass flow rate dm/dt is a function of pitches P (see FIG. 5) between the adjacent first projections 22 or between the adjacent second projections 23.

When the unit amount $N_{tu}$ of heat transfer is varied in the radial directions of the first and second heat-transfer plates S1 and S2, the distribution of temperature of the first and second heat-transfer plates S1 and S2 is non-uniformed radially, resulting in a reduced heat exchange efficiency, and moreover, the first and second heat-transfer plates S1 and S2 are non-uniformly, thermally expanded radially to generate undesirable thermal stress. Therefore, if the pitches P of radial arrangement of the first and second projections 22 and 23 are set suitably, so that the unit amount $N_{tu}$ of heat transfer is constant in radially various sites of the first and second heat-transfer plates S1 and S2, the above problems can be overcome.

Figure 10A:
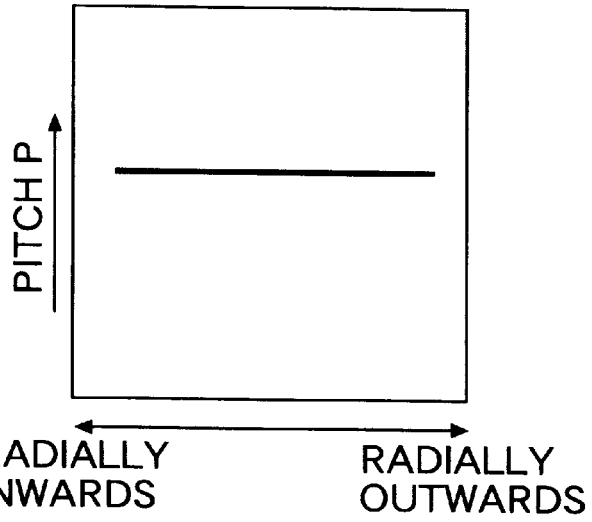
FIGS. 10A to 10C are graphs for explaining the operation when the pitch between projections is uniform.
Figure 10B:
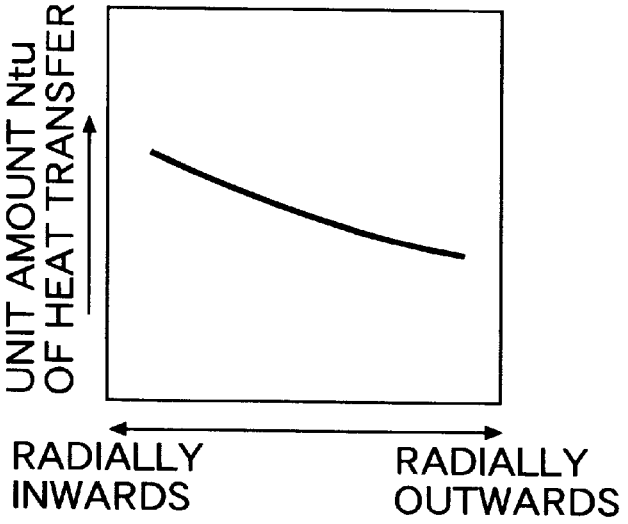
Figure 10C:
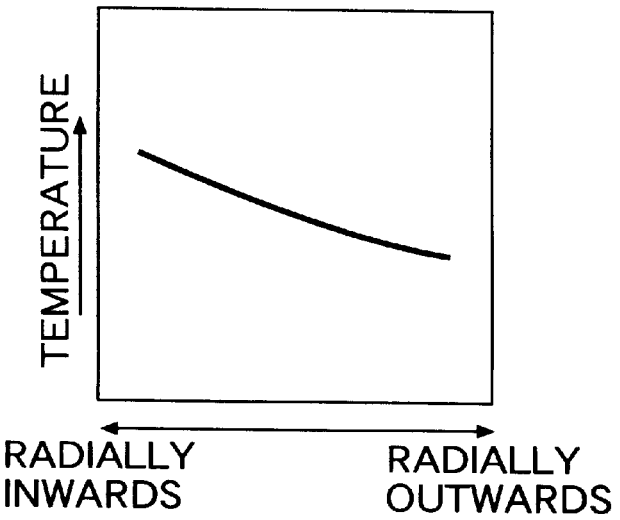
Figure 11A:
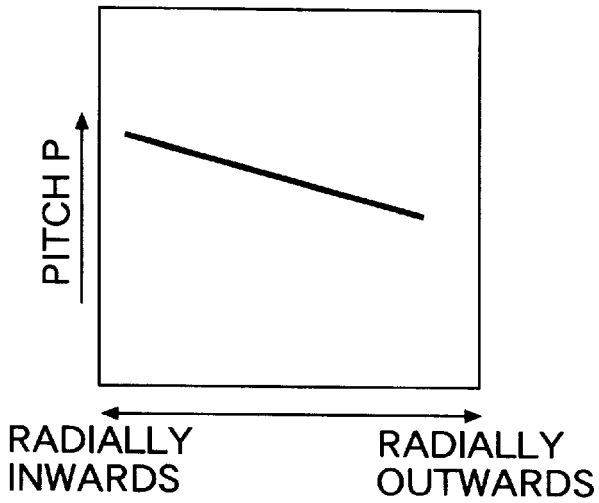
FIGS. 11A to 11C are graphs for explaining the operation when the pitch between projections is uniform.
Figure 11B:
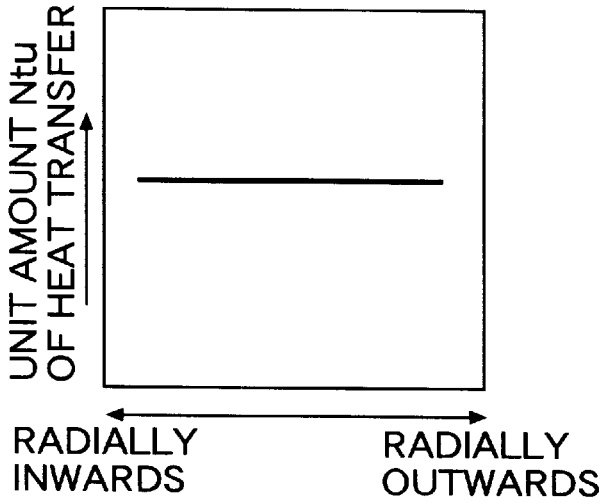
Figure 11C:
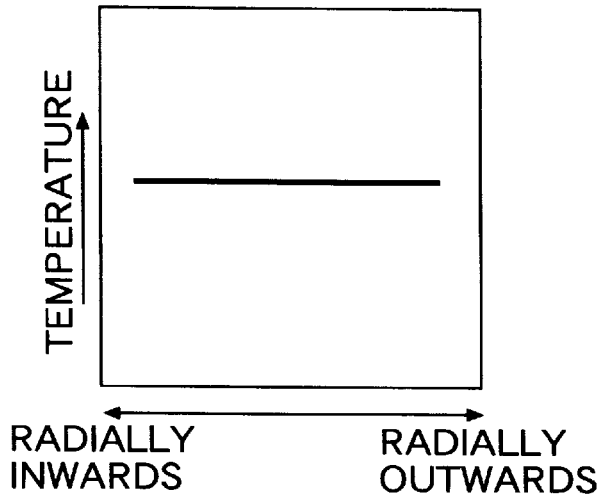

When the pitches P are set constant in the radial directions of the heat exchanger 2, as shown in FIG. 10A, the unit amount $N_{tu}$ of heat transfer is larger at the radially inner portion and smaller at the radially outer portion, as shown in FIG. 10B. Therefore, the distribution of temperature of the first and second heat-transfer plates S1 and S2 is also higher at the radially inner portion and lower at the radially outer portion, as shown in FIG. 10C. On the other hand, if the pitches P are set so that they are larger in the radially inner portion of the heat exchanger 2 and smaller in the radially outer portion of the heat exchanger 2, as shown in FIG. 11A, the unit amount $N_{tu}$ of heat transfer and the distribution of temperature can be made substantially constant in the radial directions, as shown in FIGS. 11B and 11C.

As can be seen from FIGS. 3 to 5, in the heat exchanger 2 according to this embodiment, a region having a larger pitch P of radial arrangement of the first and second projections 22 and 23 is provided in the radially inner portion of the heat exchanger 2, and a region having a smaller pitch P of radial arrangement of the first and second projections 22 and 23 is provided in the radially outer portion of the heat exchanger 2. Thus, the unit amount $N_{tu}$ of heat transfer can be made substantially constant over the entire region of the first and second heat-transfer plates S1 and S2, and it is possible to enhance the heat exchange efficiency and to alleviate the thermal stress.

If the entire shape of the heat exchanger and the shapes of the first and second projections 22 and 23 are varied, the overall heat transfer coefficient K and the mass flow rate dm/dt are also varied and hence, the suitable arrangement of pitches P is also different from that in the present embodiment. Therefore, in addition to a case where the pitches P are gradually decreased radially outwards as in the present embodiment, the pitches P may be gradually increased radially outwards in some cases. However, if the arrangement of pitches P is determined such that the above-described equation (1) is established, the operational effect can be obtained irrespective of the entire shape of the heat exchanger and the shapes of the first and second projections 22 and 23.

As can be seen from FIGS. 3 and 4, the first and second heat-transfer plates S1 and S2 are cut into an unequal-length angle shape having a long side and a short side at the front and rear ends of the heat exchanger 2. The combustion gas passage inlet 11 and the combustion gas passage outlet 12 are defined along the long sides at the front and rear ends, respectively, and the air passage inlet 15 and the air passage outlet 16 are defined along the short sides at the rear and front ends, respectively.

In this way, the combustion gas passage inlet 11 and the air passage outlet 16 are defined respectively along the two sides of the angle shape at the front end of the heat exchanger 2, and the combustion gas passage outlet 12 and the air passage inlet 15 are defined respectively along the two sides of the angle shape at the rear end of the heat exchanger 2. Therefore, larger sectional areas of the flow paths in the inlets 11, 15 and the outlets 12, 16 can be ensured to suppress the pressure loss to the minimum, as compared with a case where the inlets 11, 15 and the outlets 12, 16 are defined without cutting of the front and rear ends of the heat exchanger 2 into the angle shape. Moreover, since the inlets 11, 15 and the outlets 12, 16 are defined along the two sides of the angle shape, not only the flow paths for the combustion gas and the air flowing out of and into the combustion gas passages 4 and the air passages 5 can be smoothened to further reduce the pressure loss, but also the ducts connected to the inlets 11, 15 and the outlets 12, 16 can be disposed in the axial direction without sharp bending of the flow paths, whereby the radially dimension of the heat exchanger 2 can be reduced.

As compared with the volume flow rate of the air passed through the air passage inlet 15 and the air passage outlet 16, the volume flow rate of the combustion gas, which has been produced by burning a fuel-air mixture resulting from mixing of fuel into the air and expanded in the turbine into a dropped pressure, is larger. In the present embodiment, the unequal-length angle shape is such that the lengths of the air passage inlet 15 and the air passage outlet 16, through which the air is passed at the small volume flow rate, are short, and the lengths of the combustion gas passage inlet 11 and the combustion gas passage outlet 12, through which the combustion gas is passed at the large volume flow rate, are long. Thus, it is possible to relatively reduce the flow rate of the combustion gas to more effectively avoid the generation of a pressure loss.

Yet further, since the end plates 8 and 10 are brazed to the tip end surfaces of the front and rear ends of the heat exchanger 2 formed into the angle shape, the brazing area can be minimized to reduce the possibility of leakage of the combustion gas and the air due to a brazing failure. Moreover, the inlets 11, 15 and the outlets 12, 16 can simply and reliably be partitioned, while suppressing the decrease in opening areas of the inlets 11, 15 and the outlets 12, 16.

Figures 12, 12A, 12B:
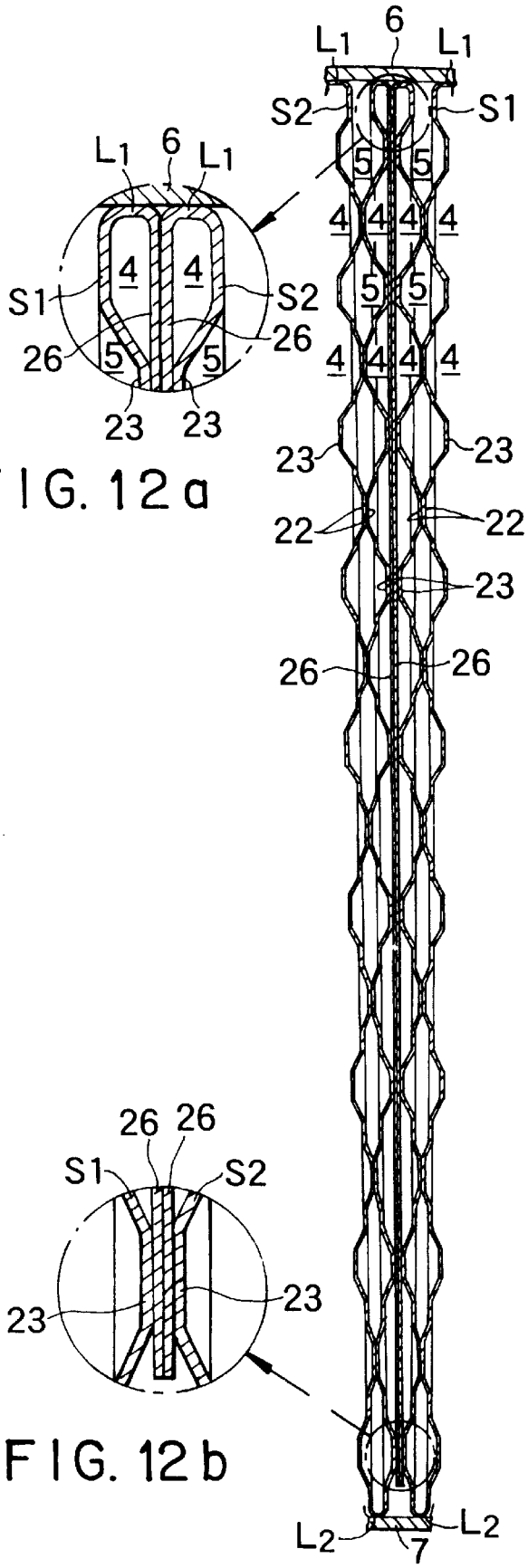
FIG. 12 is a view similar to FIG. 5, but according to a second embodiment of the present invention.

A second embodiment of the present invention will now be described with reference to FIG. 12.

The second embodiment has a structure in which flat plate-shaped extensions 26, 26 are formed by extending end edges of the first and second heat-transfer plates S1 and S2 folded along the first folding line $L_1$ in a radially inward direction, and are brought into abutment against each other and brazed to each other, and the second projections 23 protruding from the first and second heat-transfer plates S1 and S2 are brazed to outer sides of the extensions 26, 26.

With the second embodiment, end surfaces of the modules $\mathbf{2}_1$ can be reinforced with the two overlapped flat plate-shaped extensions 26, 26, thereby preventing the deformation of the first and second heat-transfer plates S1 and S2 in the bond zones.

Figures 13, 13A, 13B:
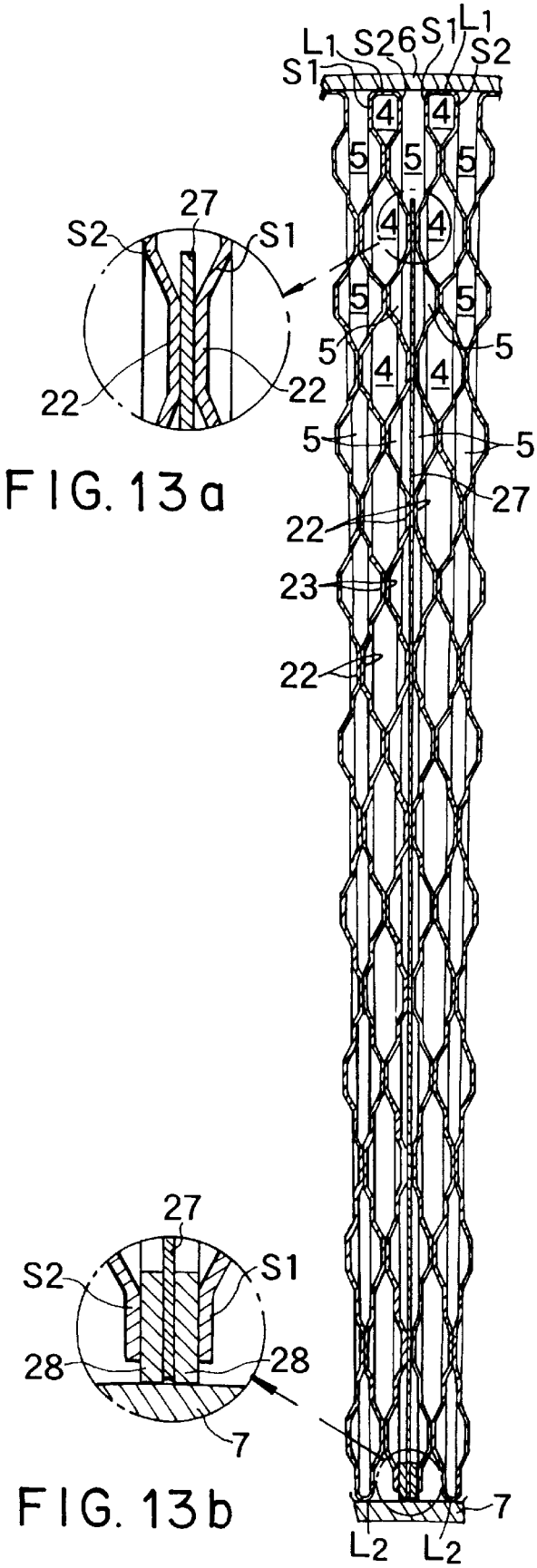
FIG. 13 is a view similar to FIG. 5, but according to a third embodiment of the present invention.

A third embodiment of the present invention will now be described with reference to FIG. 13.

In the third embodiment, when the modules $2_1$ of the heat exchanger 2 are bonded together at the bond surfaces 3 (see FIG. 3), the first and second heat-transfer plates S1 and S2 are cut at a location short of the valley-folding line $L_2$, and a partition plate 27 is clamped between the first and second heat-transfer plates S1 and S2 which are opposed to each other to carry out the brazing. In this case, a pair of ring-shaped spacers 28, 28 are fixed to opposite surfaces of an inner peripheral end of the partition plate 27, and end edges of the first and second heat-transfer plates S1 and S2 are brought into abutment against and brazed to outer surfaces of the ring-shaped spacers 28, 28, and first projections 22 of the first and second heat-transfer plates S1 and S2 are brought into abutment against and brazed to opposite surfaces of the partition plate 27.

The mounting of the modules $2_1$ is carried out in a procedure which will be described below. First, the radially inner end of the partition plate 27 integrally provided with the ring-shaped spacers 28, 28 is previously fixed to the inner casing 7, and the radially outer end of the partition plate 27 is clamped by a jig (not shown), whereby the four partition plates 27 are positioned at distances of 90° in a radial direction of the heat exchanger 2. Then, the four modules $2_1$ are inserted between the four partition plates 27, so that their end surfaces are brought into abutment against opposite surfaces of the partition plates 27. In this sate, the brazing is carried out, thereby integrally connecting the outer casing 6, the inner casing 7, the partition plates 27 and the modules $2_1$.

Thus, since the four modules $2_1$ are mounted with the partition plates 27 positioned in the radial direction being used as guides, the first and second heat-transfer plates S1 and S2 of each of the modules $2_1$ can be arranged exactly radiately, and moreover, the modules $2_1$ are simultaneously brazed to the opposite surfaces of the partition plates 27, leading to an enhanced workability. In addition, the partition plates 27 each formed of a thin plate are only applied and hence, the increase in heat mass in the bond zones is suppressed to the minimum. Further, since the first and second projections 22 and 23 of the first and second heat-transfer plates S1 and S2 are brazed to the opposite sides of the partition plates 27, it is unnecessary to braze the first projections 22 to one another or the second projections 23 to one another, and the misalignment of the first projections 22 or the second projections 23 due to a dimensional error can be absorbed. In addition, a dead space which is neither the combustion gas passages 4 nor the air passages 5 is not created and hence, there is not a possibility that the decrease of the heat exchange efficiency may be brought about.

Figures 14, 14A, 14B:
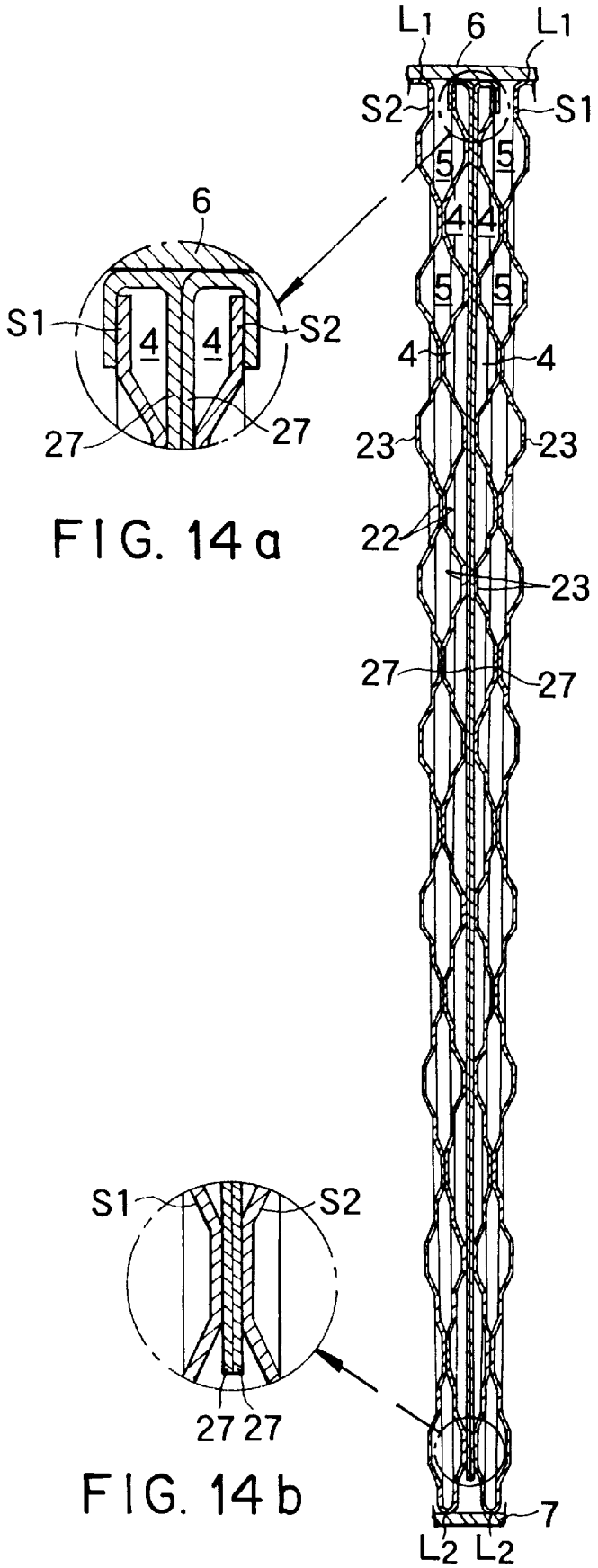
FIG. 14 is a view similar to FIG. 5, but according to a fourth embodiment of the present invention.

A fourth embodiment of the present invention will now be described with reference to FIG. 14.

The fourth embodiment includes two partition plates 27, 27 of which radially outer ends are curved into a J-shape. The radially outer ends of the partition plates 27, 27 are bonded to an end edge of the first heat-transfer plate S1 of one of the modules $2_1$ and an end edge of the second heat-transfer plate S2 of the other module $2_1$. The two partition plates 27, 27 are bonded to each other and extend radially inwards, and the second projections 23 of the first and second heat-transfer plates S1 and S2 are connected to the opposite surfaces of the partition plates 27, 27. Prior to mounting of the modules $2_1$, the radially outer ends of the partition plates 27, 27 are previously fixed to the outer casing 6, and the radially inner ends of the partition plates 27, 27 are clamped by a jig which is not shown, whereby the four pairs of partition plates 27 are positioned at distances of 90° in the radial directions of the heat exchanger 2.

Figures 15, 15A, 15B:
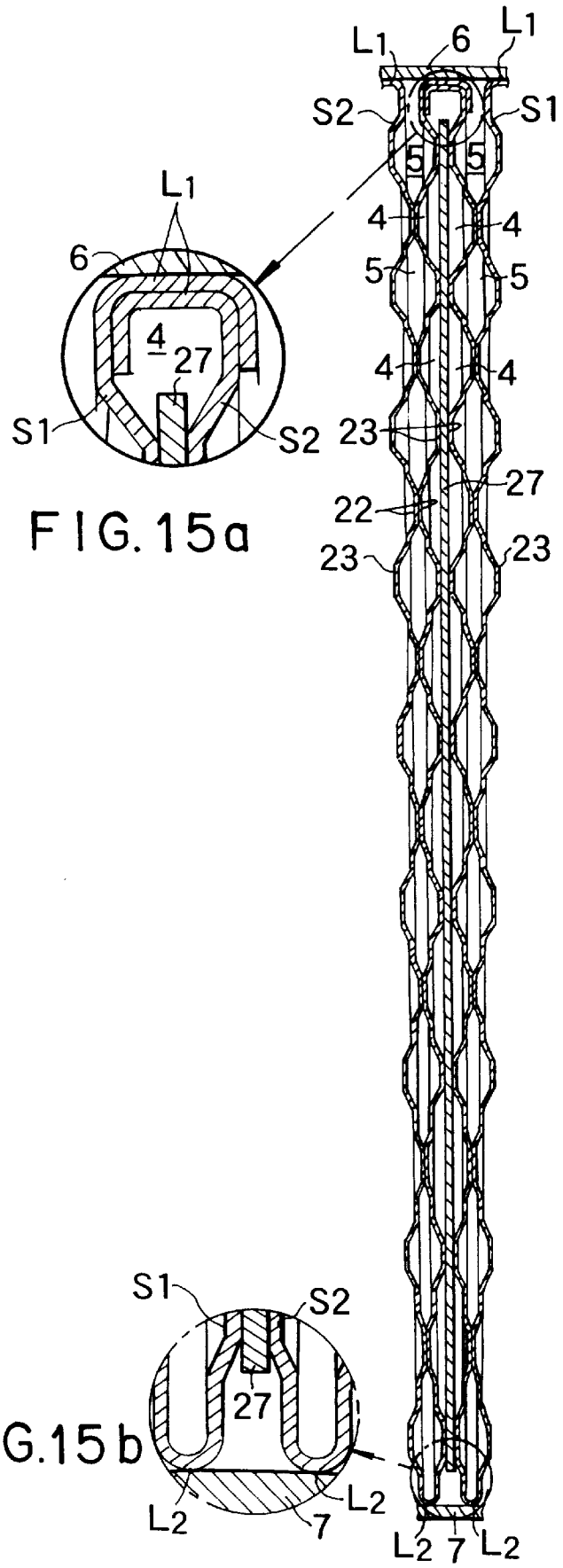
FIG. 15 is a view similar to FIG. 5, but according to a fifth embodiment of the present invention.

A fifth embodiment of the present invention will now be described with reference to FIG. 15.

The fifth embodiment includes a single, slightly thick partition plate 27. Radially outer ends of the first and second heat-transfer plates S1 and S2 having the second projections 23 bonded to opposite ends of the partition plate 27 are curved into a J-shape and bonded to each other. When the modules $2_1$ are mounted, the four partition plates 27 are positioned radially between the outer casing 6 and the inner casing 7 by a jig which is not shown. In this state, the four modules $2_1$ are bonded between the four partition plates 27.

Even with the fourth and fifth embodiments, an operational effect similar to the third embodiment can be provided.

Although the embodiments of the present invention have been described in detail, it will be understood that the present invention is not limited to the above-described embodiments, and various modifications may be made without departing from the spirit and scope of the invention defined in claims.

For example, the heat exchanger 2 for the gas turbine engine E has been illustrated in the embodiments, but the present invention can be applied to heat exchangers for other applications. In addition, the invention defined in claim 1 is not limited to the heat exchanger 2 including the first and second heat-transfer plates S1 and S2 disposed radiately, and is applicable to a heat exchanger including the first and second heat-transfer plates S1 and S2 disposed in parallel to one another. Further, the heat exchanger 2 is divided into the four modules $2_1$ in the embodiments, but the number of heat exchanger divided is not limited to the embodiments.

What is claimed is:

1. A heat exchanger, having axially extending high-temperature fluid passages (4) and high-temperature fluid passages (5) defined alternately in a circumferential direction in an annular space that is defined between a radially outer peripheral wall (6) and a radially inner peripheral wall (7), said heat exchanger comprising a plurality of modules $(2_1)$ formed by folding a plurality of folding plate blanks (21) each comprised of a plurality of first heat-transfer plates (S1) and a plurality of second heat-transfer plates (S2) which are alternately connected together through folding lines ($L_1$ and $L_2$), in a zigzag fashion along said folding lines ($L_1$ and $L_2$), said high-temperature fluid passages (4) and said low-temperature fluid passages (5) being defined alternately in the circumferential direction by said first and second heat-transfer plates (S1 and S2) disposed radiately between said radially outer peripheral wall (6) and said radially inner peripheral wall (7), by connecting said plurality of modules $(2_1)$ together in the circumferential direction; and a high-temperature fluid passage inlet (11) and a low-temperature fluid passage outlet (12) which are defined so as to open at axially opposite ends of said high-temperature fluid passages (4), and a low-temperature fluid passage inlet (15) and a low-temperature fluid passage outlet (16) which are defined so as to open at axially opposite ends of said low-temperature fluid passages (5), characterized in that a partition plate (27) is radially disposed between said radially outer peripheral wall (6) and said radially inner peripheral wall (7), and end edges of said folding plate blanks (21) forming said modules $(2_1)$ are bonded to opposite sides of said partition plate (27).

* * * * *